United States Patent [19]

Kanamaru et al.

[11] 4,249,298

[45] Feb. 10, 1981

[54] METHOD FOR CONNECTING TWO MEMBERS

[75] Inventors: Hisanobu Kanamaru, Katsuta; Hideo Tatsumi, Mito; Moisei Okabe, Hitachi; Akira Tohkairin, Katsuta, all of Japan

[73] Assignee: Hitachi, Ltd., Japan

[21] Appl. No.: 24,383

[22] Filed: Mar. 27, 1979

[30] Foreign Application Priority Data

Mar. 27, 1978 [JP] Japan ..... 53/34192

[51] Int. Cl.[3] ..... B21D 39/00; B23P 11/00

[52] U.S. Cl. ..... 29/520; 29/522 R; 29/526 R; 403/274

[58] Field of Search ..... 29/522 R, 521, 520, 29/526 R; 403/274, 278, 280; 285/382, 382.7

[56] References Cited

U.S. PATENT DOCUMENTS

| | | | |
|---|---|---|---|
| 2,278,025 | 3/1942 | Sadoski | 29/522 R UX |
| 2,313,312 | 3/1943 | Bakewell | 29/520 UX |
| 2,485,699 | 10/1949 | Christie | 29/520 X |
| 2,630,964 | 3/1953 | Scheldorf | 29/522 R X |
| 2,755,112 | 7/1956 | Klancnik | 29/522 R X |
| 2,804,679 | 9/1957 | Tracy | 29/522 R X |
| 2,964,597 | 12/1960 | Hamson | 29/522 R X |
| 3,039,186 | 6/1962 | Stayer et al. | 29/520 |
| 3,529,856 | 9/1970 | Smith et al. | 29/520 X |
| 4,003,665 | 1/1977 | Dreyer et al. | 29/520 X |

FOREIGN PATENT DOCUMENTS

| | | | |
|---|---|---|---|
| 76365 | 1/1948 | Czechoslovakia | 29/520 |

*Primary Examiner*—Charlie T. Moon

*Attorney, Agent, or Firm*—Craig & Antonelli

[57] ABSTRACT

A method for connecting two members to be connected comprises following steps. At first, a circumferential groove is formed on the connecting surfaces of the members to be connected. Secondly, axial recesses are formed on the inner surface of the groove. Thirdly, a connecting member is placed between the members to be connected. The connecting member is made of a material which has a smaller resistance against deformation than the members to be connected has and which has a required mechanical strength. Lastly, the connecting member is pressed and plastically deformed, resulting in that the connecting member flows into the groove and the recesses.

15 Claims, 22 Drawing Figures

METHOD FOR CONNECTING TWO MEMBERS

BACKGROUND OF THE INVENTION

The present invention relates to a method for connecting two members to each other by means of a third member which is cold-pressed to make a plastic flow into a gap between the connecting surfaces of the two members so as to rigidly connect these members to each other. More particularly, the invention relates to a method suitable for use in connecting two members made of a metal or a plastic for a large torque transmission, e.g. connection between a shaft and a disc, a connection between two sleeves and so forth.

Welding (including soldering), casting and riveting have been known as methods of connecting two members to each other.

As is well known, welding is not suitable for use in connecting members with high precision because members to be connected, as well as the connecting members, are distorted thermally due to the heat generated during the welding. In addition, welding is adaptable only for specific combinations of materials of the members to be connected and the connecting member. Also, it is necessary to select specific material of the welding rod or solder. In addition, welding can provide only a small yield, and require a large scale of equipments. Further, welding is more likely to incur defects in the quality of products due to a possible fluctuation of the working condition.

On the other hand, casting requires large size, complicated equipment, because it necessitates internal chills, rotation prevention mechanism and so forth, in order to ensure a sufficient connecting strength. Further, there is a limit for the selection of the material of the connecting member or the like. In addition, the casting method also suffers a small yield and low precision.

Where the connection between two members is required to withstand a torque which oscillates in two directions, as is the case of connection between a shaft and a fly-wheel of a fly-wheel magneto which is used for the ignition of small-sized internal combustion engine or lighting purposes, riveting is used for connecting them. However, connection by rivets poses various problems. For instance, the diameter of a flange of the boss is rendered large, so as to provide the areas for rivets. At the same time, a useless space or room is required in the axial direction. In addition, the rivets cannot provide an intimate contact of the two members, and the connection is rendered not so reliable.

Press-fitting and caulking have been known as the methods of directly connecting two members. However, press-fitting, can provide only a small connecting force and is less resisting particularly to an impacting force. In addition, it is difficult to obtain sufficiently high strength, when material to be connected is a metal which exhibits small elongation property, e.g. cast steel.

Caulking methods are applicable only to specific materials which exhibit low resistance against deformation. For instance, cast steel and the like cannot be used. Thus, this method cannot provide a sufficiently large connecting strength for all kinds of materials.

A also known is a connecting method in which a connecting member is interposed between two members to be connected and the connected member is plastically deformed. U.S. Pat. No. 3,559,946 shows this method. Referring to this U.S. Patent, a groove having a rectangular section is provided on the connecting surfaces of the two members. A connecting member is inserted between the two members to be connected. The connecting member is pressed so as to be plastically deformed and a part of the connecting member plastically flows into the groove. According to this method, however, since the groove has a rectangular section, the connecting member does not perfectly flow into the groove and there is a gap between the inner surface of the groove and the connecting member. Further, since the connecting force between the two materials to be connected is a frictional force between the flat inner surface of the groove and the surface of the connecting member, it cannot withstand a large torque.

SUMMARY OF THE INVENTION

An object of the present invention is to provide a method for connecting two members to be connected which does not restrict the selection materials of the members, can provide a rigid connection capable of withstanding a large oscillating torque, does not require a large number of working steps, and is easily worked in a small space.

The present invention has following characteristics. A gap is formed between confronting connecting surfaces of two members to be connected. The gap includes a groove formed in respective connecting surfaces. The groove has roughness formed on the inner surface thereof. A connecting member is formed from a material having a required mechanical strength and a lower resistance to deformation than the members to be connected. The connecting member has a height equal to or approximating the height of the gap, and a simple configuration. The connecting member is placed in the gap. Then, the connecting member is substantially enclosed by the members to be connected and a die. The connecting member is cold-pressed by a projection of the die, so as to cause a plastic flow into a significant groove of the gap, thereby to firmly connect the two members to each other.

Particularly, the characteristic of the present invention exists in the roughness formed on the inner surface of the groove of the members to be connected, whereby a large torque can be withstood.

DETAILED DESCRIPTION OF THE PREFERRED EMBODIMENTS

The invention will be more fully understood from the following description of the embodiments taken in conjunction with the accompanying drawings.

FIGS. 1 to 12 in combination show the principle of the invention.

Figure 1:
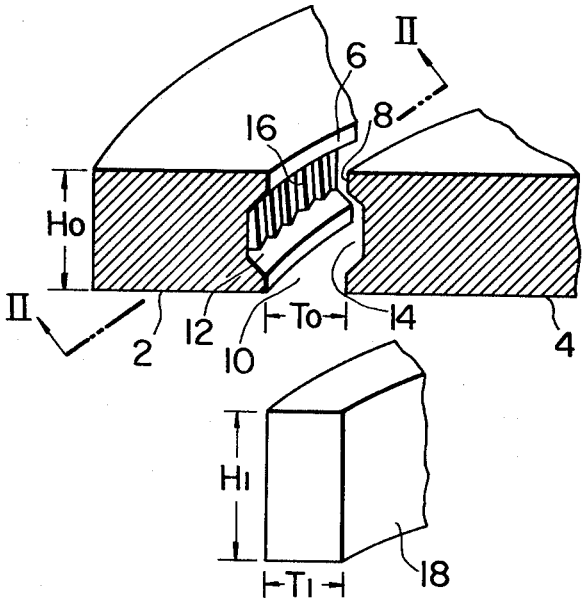
FIG. 1 is a partially sectional view showing a construction of the members to be connected and the connecting member which is used when the present invention is practiced.

Referring at first to FIG. 1, a first member 2 to be connected and a second member 4 to be connected are discs made of a metal, for instance a steel. An annular gap 10 having a width $T_o$ and a height $H_o$ is formed between the connecting surfaces 6, 8 of both members 2, 4. Circumferential continuous grooves 12, 14 are formed on the connecting surfaces 6, 8. Axial small recesses 16 are formed on the bottom surface of the grooves 12, 14 along the whole circumference, so that the bottom surface has roughness. The mean depth $h_{10}$ from the connecting surfaces 6, 8 to the neutral line m-m of the recesses 16 is preferably 0.2 to 0.1 mm and more preferably 0.2 to 0.5 mm. The height $h_{11}$ of the recesses 16 is also preferably 0.2 to 1.0 mm and more preferably 0.2 to 0.5 mm. The above-mentioned preferable values of the $h_{10}$ and $h_{11}$ are virtually unrelated to the size of the members 2, 4 to be connected.

Figure 2:
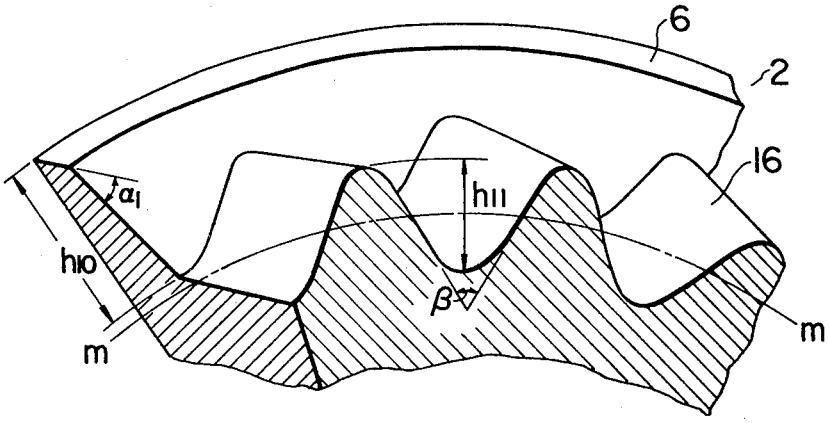
FIG. 2 is a sectional view taken along line II—II in FIG. 1.
Figure 3:
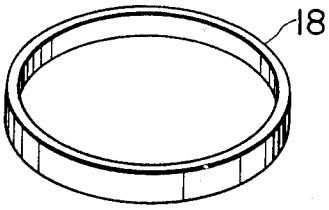
FIG. 3 is a perspective view showing the connecting member.

On the other hand, a connecting member 18 is made of a metal which is more easily plastically deformed than the members 2, 4 are, i.e. a metal having a lower resistance to deformation than the members 2, 4 to be connected. For example, aluminum, brass, copper, soft iron or the like can advantageously be used as the material of the connecting member 18. Especially considering mechanical strength required of the connecting member, soft iron is preferable. The width $T_1$ is substantially equal to or somewhat smaller than the width $T_0$ of the gap 10. It is preferable that the height $H_1$ is substantially equal to or substantially smaller than the height $H_0$. Even if the height $H_1$ is larger than the height $H_0$, the difference $\Delta H$ of the height is preferably made as small as possible, e.g. as small as 0.2 to 0.3 mm, for a reason which will be detailed later. The connecting member 18 can have a circular, oval, polygonal or other simple cross-sectional shape, as well as the rectangular cross-sectional shape as shown in FIG. 2. Since this member 18 is plastically deformed later, the shape of the connecting member 18 is not restricted by the shape of the gap 10. The connecting member 18 may be a ring formed by bending a wire material and having an end clearance, or may be a complete ring 18 produced by sintering or the like method as shown in FIG. 3.

Figure 4:
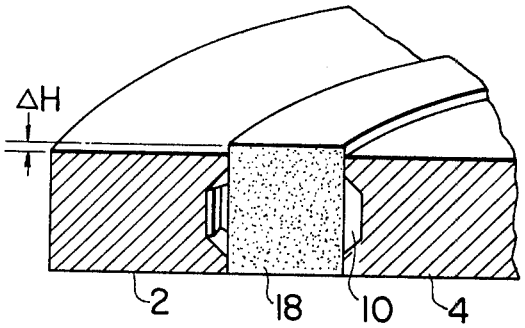
FIG. 4 is a partially sectional view showing the members to be connected and the connecting members before they are pressed.

For connecting the two members 2, 4, the connecting member 18 is placed in the gap 10 between the both members 2, 4, as shown in FIG. 4.

Figure 5:
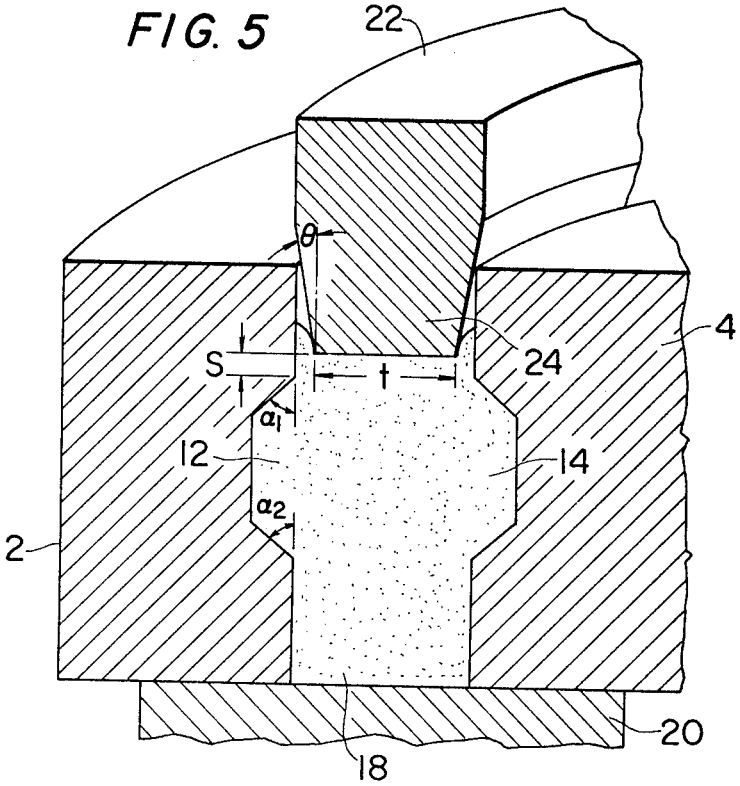
FIG. 5 and FIG. 6 are partially sectional views showing a connected portion of the members after they are pressed.

Then, the members 2, 4 to be connected with the connecting member 18 placed therebetween are put on a die 20, shown in FIG. 5. Subsequently, the connecting member 18 is compressed by means of a pressurizing portion 24 of another die 22 having an end surface of a width t smaller than the width $T_0$ of the gap 10. As a result, the connecting member 18 is caused to flow plastically into the grooves 12, 14. In the state as shown in FIG. 5, the connecting member 18 is enclosed at its sides by the wall of the members 2, 4, and at its upper and lower end portions by the dies 22, 20, and the height differential $\Delta H$ is extremely small, that is 0.2 to 0.3 mm. Thus, it is reasonable to say that the connecting member as a whole is enclosed by the walls of the members 2, 4 and the dies 20, 22, just before the cold pressing. Therefore, as shown in FIG. 5, almost no part of the connecting member 18 escapes to the outside, when it is cold-pressed.

Figure 6:
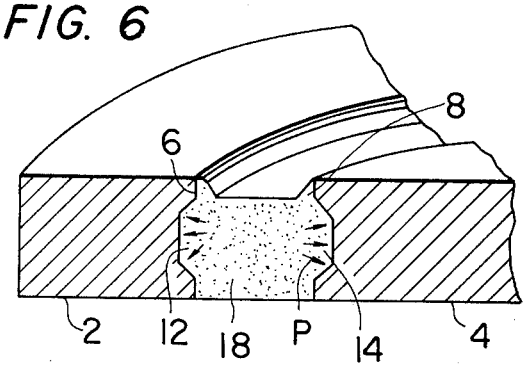

FIG. 6 shows two members 2, 4 after completion of the connection. Referring to the FIG. 6, an inner force P is caused in the connecting member 18, so as to strongly act on the walls of the grooves 12, 14 and the connecting surfaces 6, 8.

The important factors for obtaining an effect of the present invention will now be fully discussed. Namely, the factors are (I) inclination angle $\theta$ of the side wall of the pressurizing portion 24 of the die 22, (II) position of the grooves 12, 14 formed on the connecting surfaces 6, 8 of the members 2, 4, (III) mean depth $h_{10}$ of the grooves 12, 14, (IV) inclination angles $\alpha_1$, $\alpha_2$ of the side wall of the grooves 12, 14, (V) relationship between the height $H_1$ of the connecting member 18 and the height $H_0$ of the members 2, 4 to be connected, (VI) height $h_{11}$ of the recesses 16 formed in the grooves 12, 14 and (VII) top angle $\beta$ of the recesses 16.

(I) At first, an inclination angle $\theta$ of the side wall of the pressurizing portion 24 of the die 22 is now discussed.

As will be seen from FIG. 5, the side wall of the pressurizing portion 24 of the die 22 is inclined by an angle $\theta$ to the direction of insertion perpendicular to the end surface of the die 22. The angle $\theta$ is preferably 3° to 15°. Too small an angle $\theta$ will make it difficult to withdraw the die 22 after the pressing. On the other hand, too large an angle $\theta$ will allow the flow of the material of the connecting member 18 in the opposite direction to the direction of insertion of die 22, i.e. to the outside of the gap 10. At the same time, if the angle $\theta$ is too large, the die 22 cannot be driven deep into the gap 10, so that only a small stress is caused in the connecting member 18, resulting in the connection having insufficient strength.

(II) Secondly, it is now discussed as to the position of the grooves 12, 14 formed on the connecting surfaces 6, 8 of the members 2, 4 to be connected.

As shown in FIG. 5, it is preferable that the pressurizing portion 24 of the die 22 is inserted in the gap 10 as deeply as possible, so that the distance S between the end surface of the die 22 and the upper end of the grooves 12, 14 of the members 2, 4 is as small as possible; that is, the end surface of the die 22 comes near the grooves 12, 14. The distance S is a length of a friction surface between the members 2, 4 and the connecting member 18. The smaller the distance S is, the less the friction loss by a plastic flow is. As a result, the connecting member 18 can fully flow into the grooves 12, 14.

The depth of the insertion of the die 22 is enough to fill the grooves 12, 14 completely with the material of the connecting member 18, while ensuring a desired residual force in the connection member 18.

Figure 7:
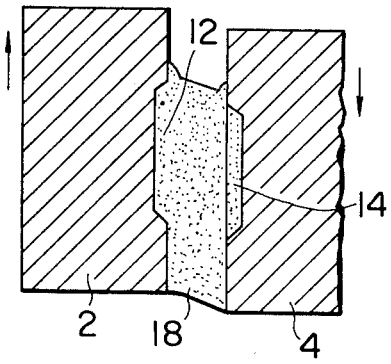
FIG. 7 and FIG. 8 are sectional views each showing a connected portion where the depth of the groove on the connecting surface is small and that where the depth is large.

(III) Thirdly, a mean depth $h_{10}$ of the grooves 12, 14 is now discussed. According to experiments, a less than 0.2 mm depth $h_{10}$ causes the connecting member 18 to slip, as shown in FIG. 7, in the grooves 12, 14 when one member 2 to be connected receives an axial force. So, a shearing force is not generated in the connecting member 18. Then, the both members 2, 4 cannot endure the axial force, resulting in a slip in the axial direction.

Figure 8:
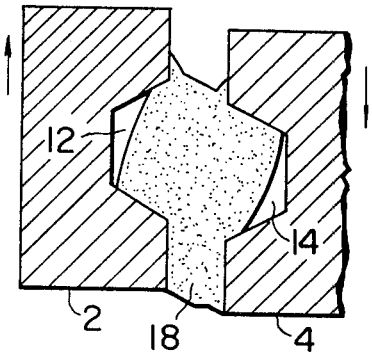

On the other hand, a more than 1.0 mm depth $h_{10}$ of the grooves 12, 14 decreases a full flow of the connecting member 18 into the grooves 12, 14, even though the connecting member 18 is compressed by the die 22 and plastically deforms. This causes, as shown in FIG. 8, a gap between the inner surface of the grooves 12, 14 and the connecting member 18. When one member 2 to be connected receives an axial force, the connecting member 18 plastically deforms. As a result, the members 2, 4 slip against with each other in the axial direction as in the case of less than 0.2 mm depth.

(IV) Fourthly, it is discussed as to inclination angles $\alpha_1$, $\alpha_2$ of the side walls of the grooves 12, 14. The inclination angle $\alpha_1$ of the upperside wall of the grooves 12, 14 is preferably 45° in is the direction of the plastic flow of the connecting member 18. An angle $\alpha_1$ in a range of 20° to 70° is applicable to a practical use. Though the upperside wall is a plane in this embodiment, a plane is the most preferable example and a curved surface may be applicable as well as a plane. In a case of a curved surface, the curved surface is preferably formed so that the angle from the tangent line at the upper end of the curved surface is smaller than a right angle, and a center portion of the surface in a range of 20° to 70°.

The inclination angle $\alpha_2$ of the lowerside wall is preferably not more than a right angle, since the connecting member 18 does not flow out of the grooves 12, 14 along this lowerside wall. Although the lowerside wall may be a curved surface as well as a plane, a plane surface is the most preferred.

(V) Fifthly, it is discussed as to the relationship between the height $H_1$ of the connecting member 18 and the height $H_0$ of the gap 10 of the members 2, 4.

Figure 9:
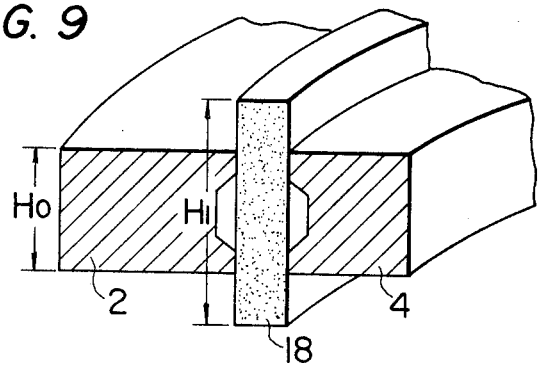
FIG. 9 and FIG. 10 are partially sectional views showing a connected portion where there is a large difference between the height of the connecting member and that of the members to be connected.
Figure 10:
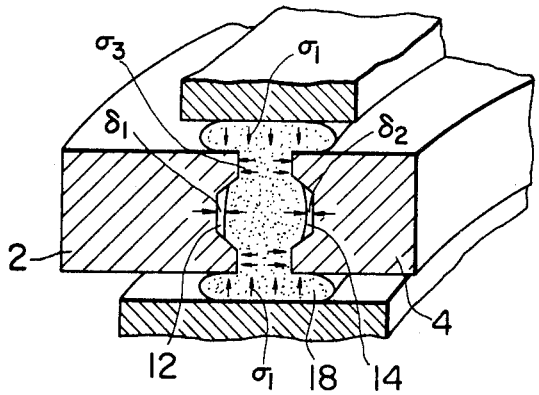

A volume of the connecting member 18 corresponding to the volume of the gap 10 between two members 2, 4 is enough to fill the gap 10 in a good manner. If the connection is made by making use of a connecting member 18 having a relatively large height differential $\Delta H$ as shown in FIG. 9, the connecting member 18 is inconveniently deformed at both of its end portions as shown in FIG. 10. Therefore, gaps, $\delta_1$, $\delta_2$ of unifilled space are left around the grooves 12, 14, even if the connecting member 18 has a volume larger than that of the gap 10, resulting in the same drawback as the aforementioned conventional connection method by using rivets. This inconvenience can be attributed to the following reason. Referring to FIG. 10, as the ring-shaped connecting member 18 is compressed axially, an axial stress $\sigma_1$, circumferential stress $\sigma_2$ (not shown) and a radial stress $\sigma_3$ are caused in the connecting member 18. Representing the resistance of the material of connecting member 18 against deformation by $K_f$, the axial stress $\sigma_1$ is given by the following equation (1).

$$\sigma_1 = (1 \text{ to } 1.5)K_f \tag{1}$$

Since both end portions of the connecting member 18 are not restricted in the radial direction during the pressing, the stress $\sigma_3$ becomes smallest when the stress $\sigma_1$ takes its maximum level.

Therefore, from TRESCA's equation which gives the condition for yielding, the following equation (2) is derived.

$$K_f = \sigma_1 - \sigma_3 \tag{2}$$

Further, the following equations (2') and (3) are derived, by substituting the equation (1) for the equation (2).

$$\begin{aligned} \sigma_3 &= \sigma_1 - K_f, && (2') \\ &= (1 \text{ to } 1.5)K_f - K_f \\ &= (0 \text{ to } 0.5)K_f && (3) \end{aligned}$$

This equation shows that a radial stress large enough to cause plastic deformation of the connecting member 18 into the grooves 12, 14 can never be produced.

On the other hand, according to the method of the present invention as illustrated in FIG. 5, the stress $\sigma_1$ is given by the following equation (4), because the whole part of the connecting member 18 is substantially enclosed and restricted by the walls of the members 2, 4 and the dies 20, 22.

$$\sigma_1 = (2 \text{ to } 4)K_f \tag{4}$$

The radial stress $\sigma_3$ is derived as follows by substituting this equation (4) for the equation (2').

$$\begin{aligned} \sigma_3 &= (2 \text{ to } 4)K_f - K_F \\ &= (1 \text{ to } 3)K_f \end{aligned}$$

It will be understood that a radial stress larger than the resistance $K_f$ against deformation is generated. The material of the connecting member 18 therefore makes a plastic flow to completely fill the grooves 12, 14. In order that the connecting member 18 may be enclosed and restricted as described during the pressing, it is required that the height $H_1$ of the connecting member 18 is substantially equal to or smaller than the height $H_0$ of the gap 10. However, if the height $H_1$ of the connecting member 18 is too small, it becomes necessary to enlarge the stroke of the die 22. However, there is a limit in enlarging the stroke, because it is not allowed to make the inclination angle $\theta$ of the side wall of the pressurizing portion 24 of the die 22 so small. Therefore, it is necessary to select a volume of the connecting member 18 somewhat smaller than that of the gap 10, and to determine the height $H_1$ taking into consideration the inclination angle $\theta$ of die 22, width $T_0$ of the gap 10 and other factors.

(VI) Sixthly, it is discussed as to a mean depth $h_{11}$ of the fine recesses 16 formed in the grooves 12, 14.

The mean depth $h_{11}$ of the recesses 16 can be treated in the same manner as the depth $h_{10}$ of the grooves 12, 14. Namely the mean depth $h_{11}$ of the recesses 16 is experimentally preferably 0.2 to 1.0 mm, more preferably 0.2 to 0.5 mm.

Figure 11:
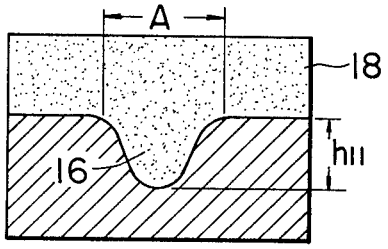
FIG. 11 and FIG. 12 are sectional views each showing a connected portion where the axial recess formed in the groove on the connecting surface has a small height and that where the axial recess has a large height.
Figure 12:
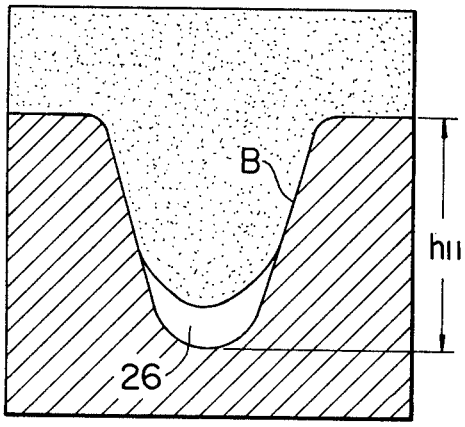

In particular, where the nearly triangular cross-sectional recesses 16 are formed by knurling, a shearing force of the connecting member 18 flowing into the recesses 16 as shown in FIG. 11 depends upon the cross-sectional area A which is comparably small, in a case of less than 0.2 mm depth $h_{11}$ of the recesses 16. As a result, the shearing force is comparably small and the connecting member 18 is destroyed, resulting in transmission of a small torque. On the contrary, in a case of more than 1.0 mm depth $h_{11}$ as shown in FIG. 12, the connecting member 18 does not readily flow into the recesses 16 because of the frictional force on the inner surface B of the recesses 16, resulting in a gap 26 at the bottom of the recesses 16. As a result, the connecting member 18 is plastically deformed by means of a circumferential force and a large torque can be withstood.

(VII) Seventhly, a top angle $\beta$ of the recesses 16 shown in FIG. 2 is preferably 60° to 120°. A less than 60° angle $\beta$ makes it difficult for the connecting member 18 to flow into the recesses 16. A more than 120° angle $\beta$ makes the torque transmissible by the recesses 16 small.

As will be understood from the foregoing description, the present invention is applicable only to such a case where a predetermined gap is maintained between the two members to be connected, e.g. a connection between two concentric discs, a connection between a shaft and a disc and so forth. Thus, the connection strength cannot be obtained in such a connection in which the gap between the members to be connected is not maintained in a constant form by these two members, e.g. a connection between two flat plates parallel to each other, even with a connecting member pressed into the gap. In other words, in order to enjoy the advantage of the invention, it is necessary that a force is exerted by the connecting member on the two members to be connected.

The present invention heretofore described offers the following advantages.

In the first place, a large torque is reliably transmitted from one member 2 to be connected to the other member 4 to be connected, since the fine recesses 16 are formed on the inner surface of the grooves 12, 14 of the two members 2, 4 to be connected. Secondly, a mechanically stable connecting strength is obtained, since an inner force P is exerted by the connecting member 18 on the connecting surfaces 6, 8 and the walls of the recesses 16 of the two members 2, 4. Thirdly, since the recesses 16 are completely filled with the material of the connecting member 18, a large resistance is produced against axial force. This resistance is a produce of the shearing strength of the material of the connecting member 18 and the shearing area of the same. Fourthly, the first and the second members 2, 4 are not distorted during the pressing and plastic flow of the connecting member 18, because they are made of a material or materials having higher resistance against deformation than the material of the connecting member 18. This ensures that high precision can be achieved in the product. This also means that the members 2, 4 to be connected can advantageously be finished to their final shape and size and surface condition, before they are connected by the method of the invention. In the fourth place, it is to be noted that any desired material suitable for the final connected product can be used as the first and second members 2, 4 of the invention, because the method of the invention can be carried out by selecting and using a material which has a lower resistance against deformation than the first and second members 2, 4, as the material for the connecting member 18. It is also to be noted that the connecting member 18 having a simple form can be produced easily. Further, since the connection is effected by a cold-pressing, the work can be done easily so as to produce a high yield, by a relatively small scale equipment such as a hydraulic press.

A basic construction or principle of the invention has been described. Hereinafter, several practical examples of application of the invention, as well as their advantages, will be described.

Figure 13:
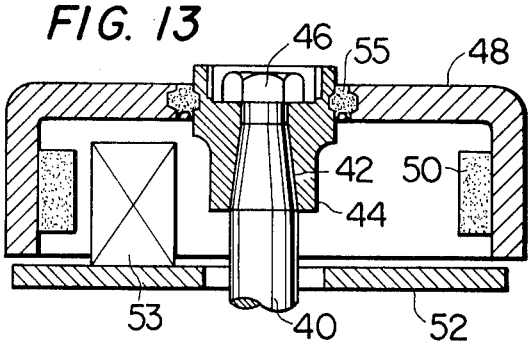
FIG. 13 is a sectional view showing a fly-wheel magneto to which the present invention is applied.

FIG. 13 shows an essential part of a fly-wheel magnet produced in accordance with the method of the invention. In FIG. 13, a shaft 40 adapted to be driven by an internal combustion engine has a tapered end 42. A boss 44 is fixed to the shaft 40 by means of a nut 46. A fly-wheel 48 is fixed to the boss 44 by the present connecting method. A magnet 50 is attached to the fly-wheel 48, while a coil 53 is attached to a stationary plate 52. Since the output torque of the internal combustion engine changes periodically or intermittently, the connection between the boss 44 fixed to the shaft 40 and the fly-wheel 48 has to withstand a large oscillating torque. The boss 44 and the fly-wheel 48 are connected by the connecting means 55.

Figure 14:
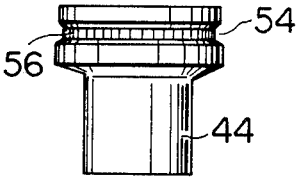
FIG. 14 is a perspective view of a boss in FIG. 13.
Figure 15:
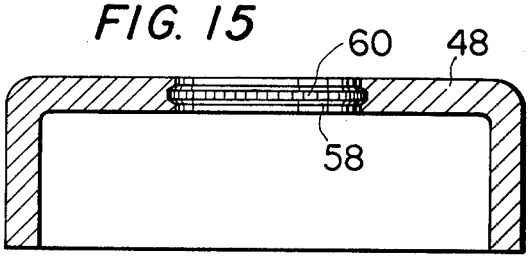
FIG. 15 is a sectional view of a fly-wheel in FIG. 13.

As will be seen from FIG. 14, the boss 44 is provided at its outer peripheral connecting surface with a circumferential groove 54 having fine axial recesses 56 in its bottom surface. The recesses 56 can be formed by a knurling as shown in FIG. 16 or by a bit as shown in FIG. 17 and FIG. 18.

Figure 16:
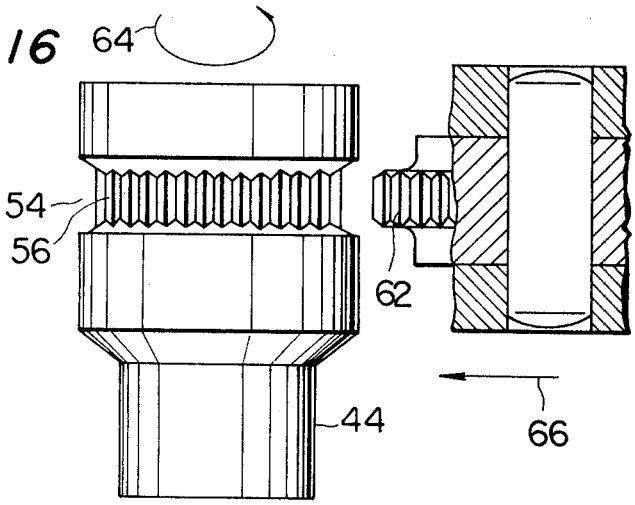
FIG. 16 to FIG. 18 show examples of manufacturing the recess.

Referring to FIG. 16, a knurling wheel 62 is adapted to be pressed as shown by the arrow 66 against the boss 44, and, as the boss 11 is rotated in the direction of the arrow 64, fine recesses 56 are formed on the bottom of the groove 54.

Figure 17:
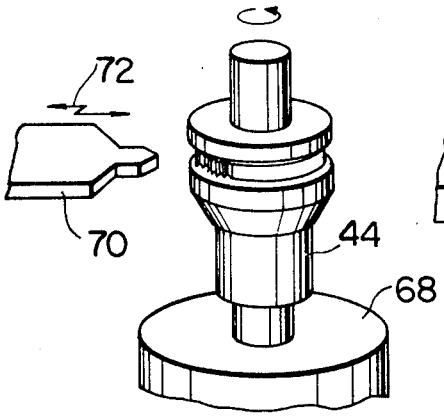

Referring to FIG. 17, the boss 44 is held on a rotary bed 68 through a shaft. As the rotary bed 68 is rotated, a bit 70 is pressed in a vibrating or oscillating manner in the direction of the arrow 72 so as to form the recesses.

Figure 18:
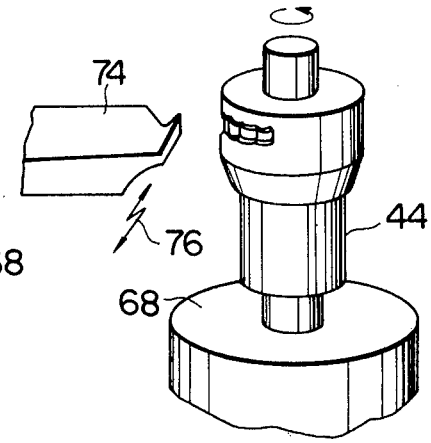

It is possible to adopt a method as shown in FIG. 18 in which the bit 74 is driven in a vibrating manner in an oblique direction as an arrow 76. In this case, the groove 54 and the recesses 56 are simultaneously formed.

Figure 19:
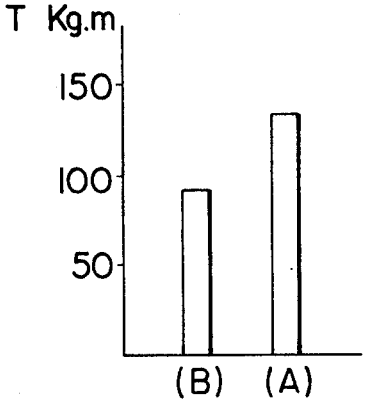
FIG. 19 is a graph showing an amount of torque (T) according to the present convention in comparison with that by using rivets.

FIG. 19 shows the result of the test conducted to confirm the resistance of the connection of the invention (A) against the torque (T), i.e. the torque at which the connection is broken, in comparison with that of the conventional connection (B) by means of six rivets. More specifically, in the connecting construction of the invention, a soft iron was used as the material of the connecting member. The outer diameter of the boss was 38 mm. The inner diameter and the outer diameter of the fly-wheel were 42 mm and 102 mm, respectively. The mean depth $h_{10}$ of the circumferential groove and the mean height $h_{11}$ of the axial recesses were both 0.3 mm. The inclination angles $\alpha_1$, $\alpha_2$ of the side walls of the circumferential groove were both 45°. The width of the circumferential groove was 2 mm. As a result of application of a static torque, the connection withstood the torque until it was was increased up to 135 kg. m. In conventional connecting construction, the outer diameter of the boss was 38 mm. The inner diameter and the outer diameter of the fly-wheel were 42 mm and 102 mm, respectively. Six rivets each having a diameter of 6 mm were used and disposed on a circle of 60 mm diameter. This conventional connecting construction was broken when the static torque was increased to 92.5 kg. m.

Also, the connecting construction with the fine axial recesses on the inner surface of the groove of the boss and the fly-wheel withstood three times as large torque as that without fine axial recesses.

Figure 20:
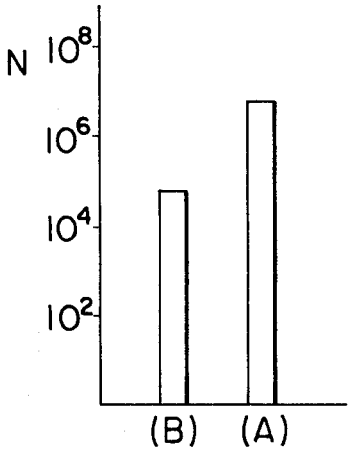
FIG. 20 is a graph showing the number (N) of repetition of impacts according to the present invention in comparison with that by using rivets.

FIG. 20 shows the result of a repetitional impact test (angular acceleration) conducted with the connecting construction of the invention and the conventional construction similar to those of the static test. The weight of the fly-wheel was 1.4 kg. The angular acceleration $\dot{\omega}$ was 5 rad/sec$^2$. The number (N) of repetition of impacts withstood by the method of the invention (A) was as large as $6\times10^6$ times, while the conventional construction (B) by rivets could withstand only $5\times10^4$ times of repetition.

Figure 21:
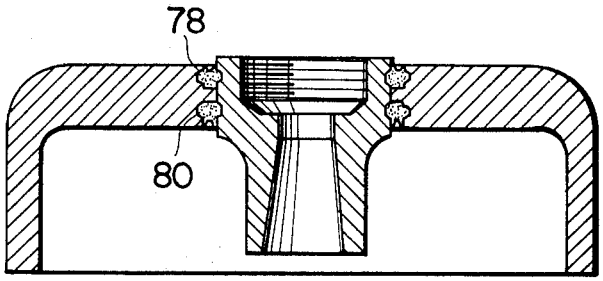
FIG. 21 and FIG. 22 are sectional views each showing another embodiment of the present invention.

Though FIG. 13 shows the connection by only one groove of the boss and the fly-wheel, for obtaining a larger connecting strength the boss and the fly-wheel may be connected at axially separated two grooves 78, 80 as shown in FIG. 21.

Figure 22:
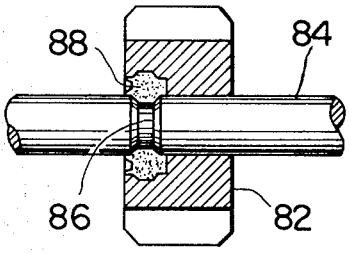

FIG. 22 shows another practical application of the invention in which a gear is connected to a shaft. The gear 82 has a central bore of a diameter equal to the outer diameter of the shaft 84. A groove is formed in the surface of the bore, to a predetermined depth from the end surface of the gear 82. Axial recesses similar to those in the first practical example are formed on the bottom of the groove of the gear 82.

On the other hand, the shaft 84 has a groove corresponding to that of the gear 82. The groove of the shaft 84 also has the axial recesses 86 on its bottom surface. The shaft 84 and the gear 82 are connected to each other substantially in the same manner as that in the first practical example. Namely, after fitting the shaft 84 into the bore of the gear 82, a connecting member 88 is cold-pressed into the gap including the groove. The connecting construction thus obtained can withstand a large torque, and is never degraded by an application of impacting torque.

The described practical applications are not exclusive, and the invention can be applied to various forms of connection, such as a connection of a cylinder to a shaft, a connection of a shaft to a flat plate, as well as mutual connection of disc, cylinder, shaft, column, flat plate, rod and so forth.

We claim:

1. A method for connecting two members to be connected by means of another connecting member comprising:

(a) forming a circumferential groove on connecting surfaces of each of first and second members to be connected;

(b) forming roughness on an inner surface of the circumferential groove of each of the first and second members;

(c) positioning said first and second members so as to define a gap therebetween bounded on opposite sides by the connecting surfaces of the first and second members;

(d) placing a connecting member in the gap between the connecting surfaces of the first and the second members to be connected, the connecting member being made of a material which has a lower resistance to plastic deformation than that of which the first and the second members to be connected are formed and has a required mechanical strength; and (e) pressing and plastically deforming the connecting member in a manner whereby the circumferential groove and the roughness are filled with the connecting member.

2. A method according to claim 1, wherein the circumferential groove is a continuous one formed on the whole circumference of the connecting surfaces of the first and the second members to be connected.

3. The method according to claim 2, wherein a plurality of the circumferential grooves are formed axially separated with respect to one another.

4. The method according to claim 1, wherein the roughness is formed by a series of alternating axially extending ridges and recesses.

5. A method according to claim 1 or 4, wherein the roughness is formed by a knurling.

6. A method according to claim 1 or 4, wherein the roughness is formed by a vibrating or oscillating bit.

7. A method according to claim 1, wherein the roughness includes recesses formed in the axial direction.

8. A method according to claim 1 or 4, wherein the mean depth of the groove is preferably 0.2 to 1.0 mm.

9. A method according to claim 7, wherein the height of the roughness is preferably 0.2 to 1.0 mm.

10. A method according to claims 4 or 7, wherein said recesses are laterally bounded by wall surfaces oriented with respect to each other so as to define an angle therebetween.

11. A method according to claims 1 or 9, wherein a height $H_1$ of said connecting member is selected so as to be not more than 0.2 to 0.3 mm larger than a height $H_o$ of said first and second members.

12. A method according to claims 1 or 7, wherein said first member is annular and said second member is concentrically positioned within said first member.

13. A method according to claim 12, wherein said first member is a fly-wheel and said second member is a shaft mounting boss.

14. A method according to claim 1, wherein said step of pressing and plastically deforming is performed by an end of a die having an end surface and side surfaces adjoining said end surface, said side surfaces being inclined at an angle of 93° to 105° relative to said end surface.

15. A method according to claim 14, wherein said die is inserted into said gap in a direction perpendicular to said end surface, and wherein an upper wall of said grooves are inclined at an angle of 20° to 70° relative to the direction of die insertion.

* * * * *